United States Patent [19]

Takagi

[11] Patent Number: 4,961,658

[45] Date of Patent: Oct. 9, 1990

[54] FEED ROLLER RELEASE DUE TO CARRIAGE MOVEMENT IN A PRINTING APPARATUS

[75] Inventor: Kazuhiko Takagi, Nagoya, Japan

[73] Assignee: Brother Kogyo Kabushiki Kaisha, Nagoya, Japan

[21] Appl. No.: 206,315

[22] Filed: Jun. 14, 1988

[30] Foreign Application Priority Data

Jun. 15, 1987 [JP] Japan ..... 62-92599[U]
Jun. 15, 1987 [JP] Japan ..... 62-92600[U]

[51] Int. Cl.[5] ..... B41J 13/03

[52] U.S. Cl. ..... 400/636.1; 400/320; 400/706; 400/708

[58] Field of Search ..... 400/624, 625, 629, 630, 400/636, 636.1, 636.2, 637, 637.1, 639, 639.1, 639.2, 703, 706, 708, 708.1, 711, 320, 185

[56] References Cited

U.S. PATENT DOCUMENTS 4,437,780 3/1984 Weber et al. ..... 400/636.1
4,498,795 2/1985 Tatara ..... 400/636.1
4,518,271 5/1985 Hirata ..... 400/636.1
4,560,295 12/1985 Fujiwara et al. ..... 400/637.1
4,580,917 4/1986 Hibino ..... 400/636.2

FOREIGN PATENT DOCUMENTS 3534118 4/1987 Fed. Rep. of Germany ..... 400/636
84885 5/1982 Japan ..... 400/639.1
18549 1/1985 Japan .
1563 1/1987 Japan ..... 400/637
73971 4/1987 Japan ..... 400/639.1

*Primary Examiner*—David A. Wiecking
*Attorney, Agent, or Firm*—Finnegan, Henderson, Farabow, Garrett & Dunner

[57] ABSTRACT

A printer comprising a frame, a platen for supporting printing paper, a carriage reciprocally movable along said platen and having a print head mounted thereon defining a print point, paper feed rollers for feeding said printing paper through said printing point, at least one back-up roller disposed at an upstream side of said printing point and rotationally abutted against one of said paper feed rollers, at least one discharge roller disposed at a downstream side of said printing point and movable toward and away from another of said paper feed rollers, and a discharge roller driver for moving said discharge roller toward and away from said roller, said discharge roller driver moving said at least one discharge roller toward said roller for nipping said printing paper therebetween prior to the release of a tail edge of said printing paper from between said at least one back-up roller and said paper feeder, a link disposed in parallel with said platen and having a first end portion and a second end portion, each said portion being engageable with said carriage, said link for moving said discharge roller toward and away from said roller, a linking member connected to said link, and a movable portion connected between said linking member and said discharge roller.

13 Claims, 9 Drawing Sheets

FEED ROLLER RELEASE DUE TO CARRIAGE MOVEMENT IN A PRINTING APPARATUS

BACKGROUND OF THE INVENTION

1. Field of the Invention

The present invention relates to a printing apparatus having a feed mechanism for feeding paper to a printing portion including a printing head and a platen.

2. Description of the Related Art

Generally, a printing apparatus includes a print portion having a printing head and a platen confronting the print head. A paper supply roller is rotatably provided at an upstream side of the printing portion. Further, a paper feed roller is rotatably disposed in abutment with the paper supply roller. The paper feed roller and the paper supply roller cooperate to feed paper to the print portion.

According to a conventional printing apparatus, it becomes impossible to further feed the paper toward the print portion and to positively discharge the paper therefrom, once the tail end of the paper feed means at a downstream side of the print portion. Accordingly, the printing operation cannot be performed in a paper zone between the printing portion and the tail end of the paper. This problem is particularly recognized when printing on small sized paper such as a post card since the non-printed or blank portion occupies a relatively large area in comparison to the printed portion. Therefore, economical printing may not be attainable.

In order to overcome this drawback, Japanese Patent Publication No. 60-18549 discloses a supplemental roller at the downstream side of the print portion in addition to the rollers at the upstream side thereof. The supplemental roller is rotated at an angular speed equal to that of the upstream side roller, and has a diameter larger than that of the upstream roller. With the structure, the paper is fed by both upstream and downstream rollers under tension.

In this conventional printer, a pressure roller is provided in abutment with each of the upstream and downstream side rollers to apply tension to the paper undergoing feeding. Even though the pressure roller may be movable toward and away from the supplemental roller by manual operation, the pressure roller is always in contact with the supplemental roller during the printing operation. Therefore, if there are dimensional errors with respect to at least one of the upstream and downstream side rollers, excessive tension may be applied to the paper, or excessive slacking may occur during printing operation.

Further, due to the difference in diameters between these rollers for tension application to the paper, it becomes impossible to feed paper in the reverse direction. During reverse feeding, paper slacking occurs at the print portion due to the diametrical difference between the rollers, and due to the fact that both the upstream and downstream sides of the paper with respect to the print portion are subjected to nipping.

SUMMARY OF THE INVENTION

It is, therefore, an object of the present invention to overcome the above-mentioned drawbacks and disadvantages, and to provide an improved printing apparatus having an improved paper feed mechanism and system.

Another object of the invention is to provide an apparatus capable of continuously feeding paper eve if the tail end of the paper passes over the paper supply roller.

Still another object of the invention is to provide an apparatus which performs stabilized printing to the tail end zone of the paper.

Still another object of the invention is to provide the paper feed mechanism and a paper feed control system which enables reverse movement of the paper while avoiding paper slacking.

These and other objects of the invention will be attained by providing a movable discharge roller which is subjected to timing control for selectively contacting a second paper supply roller in a second paper feed means disposed on the downstream side of the printing portion.

To attain these objects, and in accordance with the present invention, there is provided a printer including a frame, a platen for supporting printing paper, and a carriage reciprocally movable along the platen and having a print head thereon. The platen, the carriage and the print head define a printing portion. The printer further includes paper feed means for feeding the printing paper through the printing portion; at least one back-up roller disposed at an upstream side of the printing portion and rotationally abutted against the paper feed means; at least one discharge roller disposed on the downstream side of the printing portion and movable toward and away from the paper feed means; and discharge roller driving means for moving the discharge roller toward and away from the paper feed means. The discharge roller driving means moves the discharge roller toward the paper feed means for nipping the printing paper therebetween prior to release of a tail edge of the printing paper from the at least one back-up roller.

According to one aspect of the invention, there is provided a mechanical roller driving mechanism for moving the discharge roller in response to a reciprocal motion of a carriage. According to another aspect of the invention, there is provided electrical roller driving means for moving the discharge roller in response to an actuation of a solenoid.

DETAILED DESCRIPTION OF THE INVENTION

A first embodiment according to the present invention will now be described with reference to FIGS. 1–5, FIGS. 7 and 9. Throughout the specification, the expressions "front", "rear", "above", "below" and "laterally" are used to define the various parts when the printer is disposed in its intended orientation.

Figure 3:
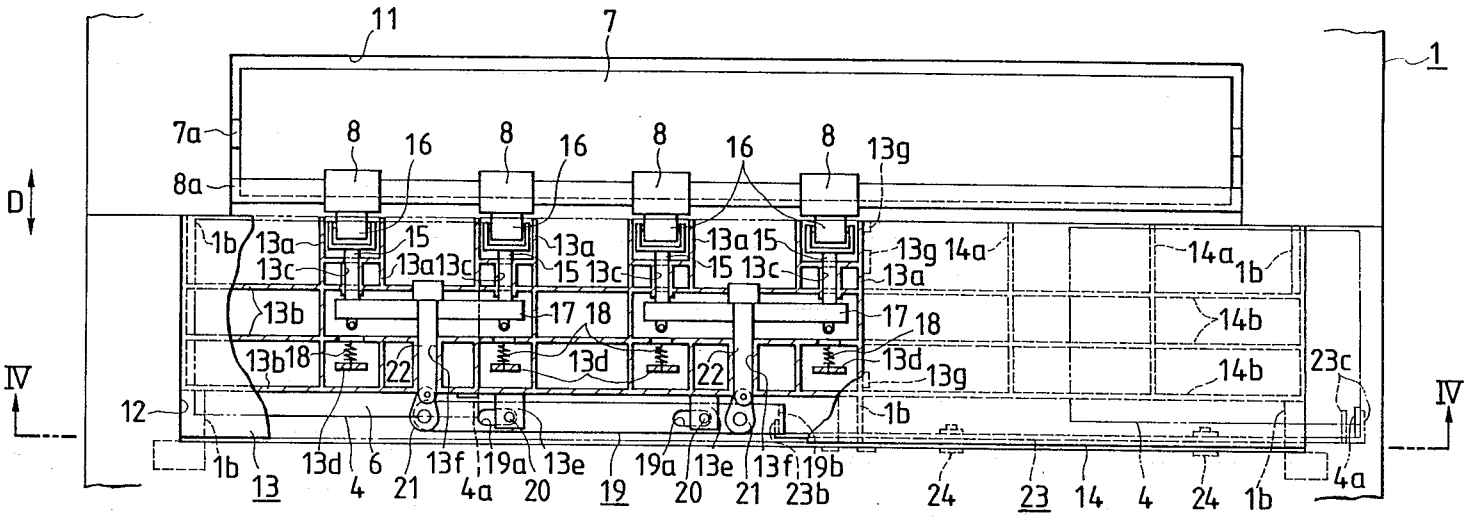
FIG. 3 is a plan view showing the printing apparatus depicted in FIG. 1.
Figure 4:
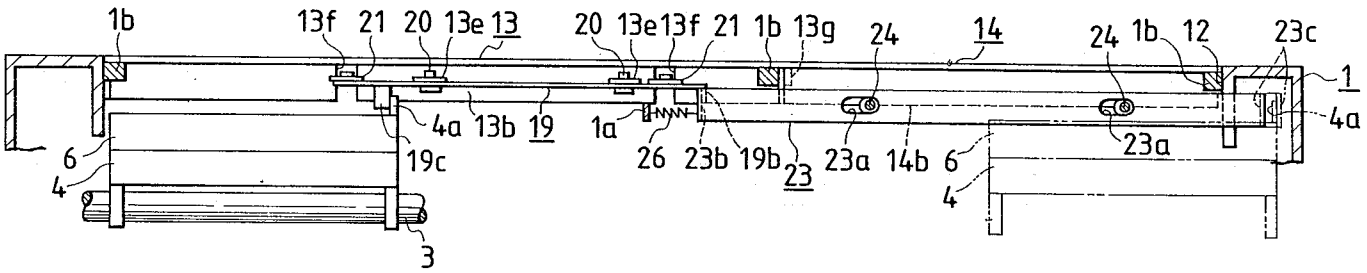
FIG. 4 is a cross-sectional view taken along the line IV–IV of FIG. 3.
Figure 5:
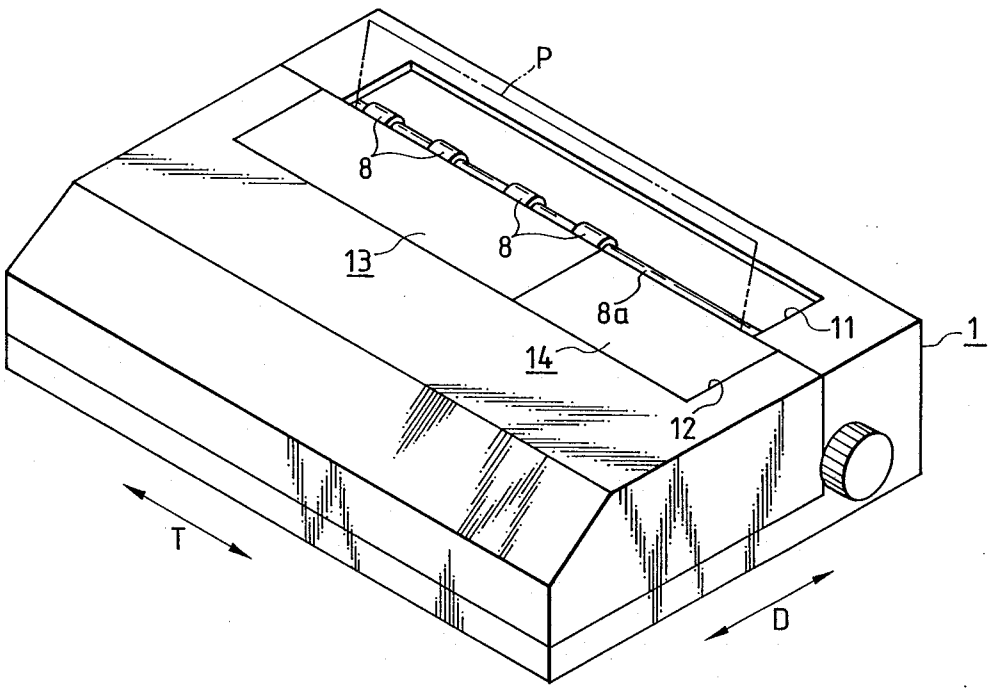
FIG. 5 is a perspective view showing the printing apparatus according to a first embodiment of the present invention.

As shown in FIGS. 3–5, a frame 1 is formed with a first opening 11 for supplying and discharging paper P relative to a print portion, and a second opening 12 is provided for mounting and dismounting a ribbon cassette. The second opening 12 is covered with large and small lid members 13 and 14 positioned side by side. A plurality of engaging portions 1*b* are provided at an internal side of the frame 1 at positions corresponding to the four corner portions and an intermediate portion of the opening 12. Engaging portions 1*b* detachably engage the large lid member 13 (left side in the drawings). Further, the large lid member 13 has one end (right side in the drawings) provided with a plurality of projections 13*g* engageable with the engaging portion 1*b*. In a similar manner, the small lid member 14 is detachably supported at the right side of the second opening 12. Furthermore, a plurality of ribs 13*a*, 13*b*, 14*a*, 14*b* project downwardly from lower surfaces of the lid members 13 and 14 and extend in transverse and depthwise directions of the frame 1.

Figure 1:
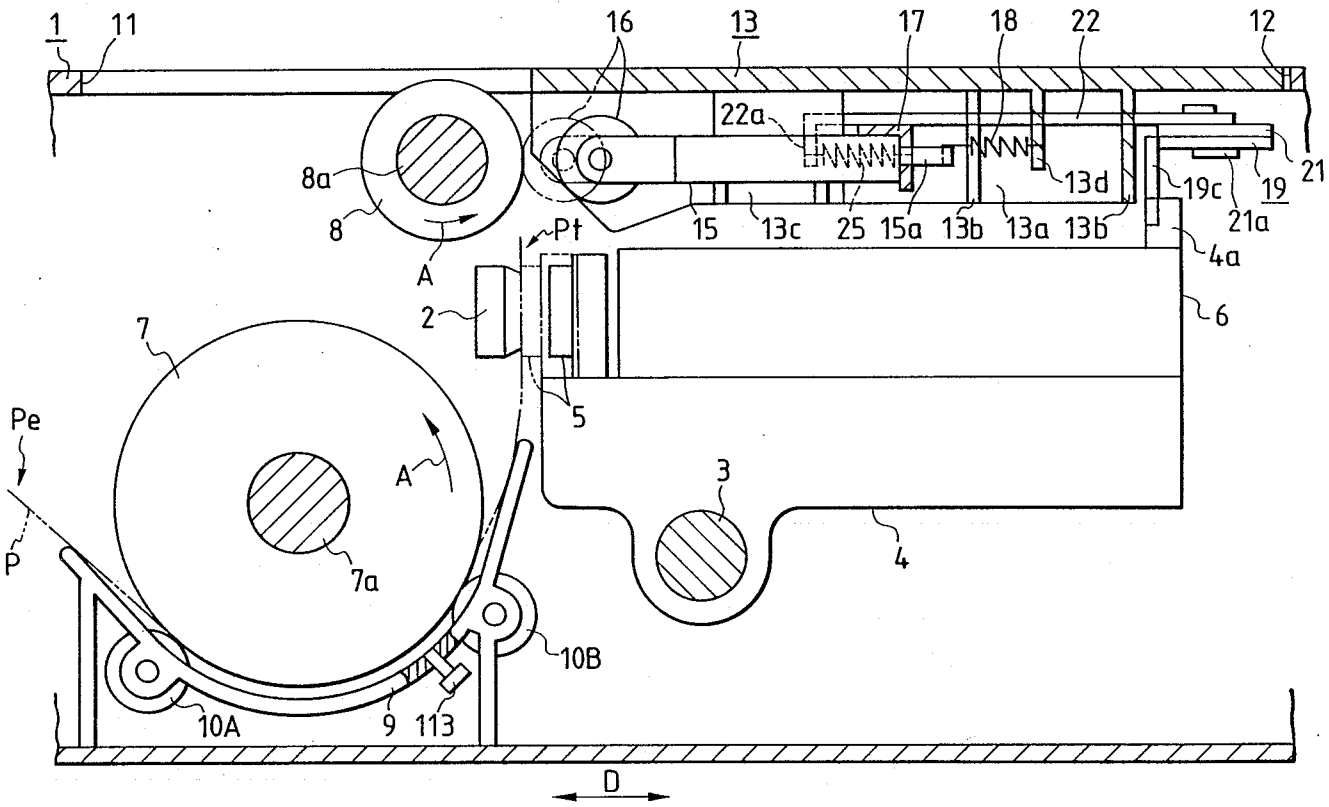
FIG. 1 is a side view partly cross-sectioned showing a printing apparatus according to a first embodiment of the present invention.

As shown in FIG. 1, an elongated platen 2 is disposed within the frame 1, and a guide shaft 3 extends parallel to platen 2. A carriage 4 is movably mounted on the guide shaft 3. The carriage 4 is movable by a carriage drive motor 105 (FIG. 7) along platen 2 and lid members 13, 14 between leftmost position and rightmost position as shown by solid and two-dotted lines in FIG. 4. Further, a locking portion 4*a* (FIG. 4) extends upwardly from an upper portion of the carriage 4 at the right side thereof.

A thermal-type print head 5 is mounted on carriage 4 and platen 2. Platen 2 and print head 5 constitute a printing portion. A ribbon cassette 6 is mounted on carriage 4. An ink ribbon is disposed within ribbon cassette 6 and is partly exposed to a space defined between the print head 5 and the platen 2 for travel therethrough.

During the reciprocal movement of the carriage along the guide shaft 3, the print head 5 is moved toward and away from the platen 2. In FIG. 1, the print position is shown by a double-dotted line and the retract position is shown by a solid line. The printing operation is performed by the actuation of the print head 5 when brought into the print position. Further, when the carriage 4 is brought to a position below the small lid member 14, the ribbon cassette 6 mounted on the carriage can be replaced with a new cassette by removing the lid 14.

At the lower portion of the platen 2, namely at the paper supply side with respect to the print portion, a first paper supply roller 7 is rotatably mounted about a first support shaft 7*a* that extends parallel to platen 2. Further, at the upper portion of the platen 2, namely at the paper discharge side, a set of second paper supply rollers (four rollers in this embodiment, see FIG. 3) are rotatably provided about an axis of a second support shaft 8*a* extending in parallel with the first shaft 7*a*. A paper supply roller-drive motor, such as a pulse motor (110 in FIG. 7), is connected to these support shafts 7*a* and 8*a*, and rollers 7 and 8 are synchronously rotated at a peripheral speed substantially equal to each other and in the same direction in response to actuation of motor 110. The first and second paper supply rollers 7 and 8 constitute paper transfer means for transferring the paper P through the printing portion.

A paper guide plate 9 is fixedly secured to the frame 1 for guiding travel of the paper P. The guide plate 9 is positioned immediately below the first paper supply roller 7, and has an arcuate shape in conformance with an outer peripheral circle thereof. Further back-up rollers 10A and 10B are rotatably provided in the arcuate guide plate 9 at positions close to and far from the print portion. These back-up rollers 10A and 10B are in rotational abutment with the first supply roller 7. Furthermore, a paper edge detector 113 is provided on the guide plate 9 between the back-up rollers 10A and 10B. The detector 113 is positioned closer to the back-up roller 10B which is closer to the print portion than the other roller 10A. The detector 113 is adapted to generate a detection signal upon detecting a leading edge Pt and a tail edge Pe of the pape P.

A discharge roller drive means is provided within the frame 1. The drive means includes a movable arm 15 which is moved toward and away from the second paper supply roller 8. Details of the discharge roller drive means will now be described.

Figure 2:
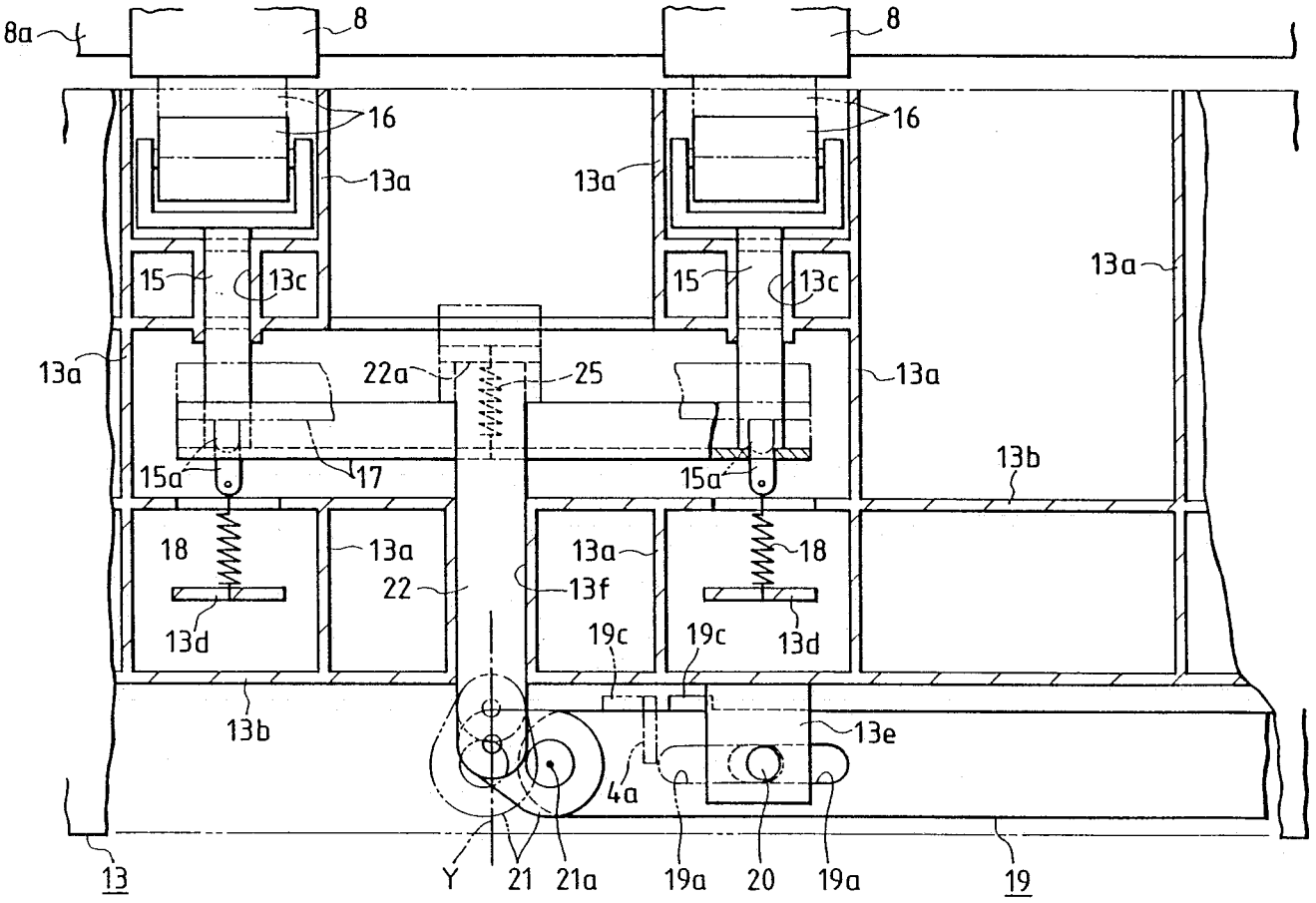
FIG. 2 is a plan view partly cross-sectioned showing essential portions of the roller moving mechanism according to a first embodiment of the present invention.

As shown in FIGS. 1–4, a pair of guide members 13*c* is provided between each pair of ribs 13*a*. Ribs 13*a* are positioned to correspond to the longitudinal ends of each of the second supply rollers 8. Each of the guide members 13*c* extends frontwardly (depthwise direction D in FIGS. 1, 3 and 5) in parallel with the ribs 13*a*, at a rear internal portion of the lid member 13. Further, each of the above-described movable arms 15 is slidably disposed between each of pair guide members 13*c*. The movable arms 15 are slidable in the depthwise direction D. The free end of the movable arm 15 is rotatably provided with the discharge roller 16, while the base end is provided with a protrusion 15*a* (FIG. 2). A connecting piece 17 having an inverse L-shaped cross-section is provided between two protrusions 15*a* at the left side of the lid member 13 and between two protrusions 15*a* at the right side of the lid member 13. Each of the connecting pieces 17 extends in transverse direction T (in FIG. 5), and both ends of the connecting piece (rod) 17 are engaged with the protrusions 15*a*. Therefore, each pair of movable arms 15 are concurrently slidably movable by the movement of the connecting piece 17 in depthwise direction D. Further, each spring holder 13*d* extends downwardly from the lid member 13 at positions corresponding to each of the protrusion 15*a* which extend through the connecting piece 17. A tension spring 18 is provided between the protrusion 15*a* and the spring holder 13*d*. The biasing force of the spring 18 simultaneously urges movable arm 15 and connecting piece 17 toward the front side of the printing machine, i.e., toward the direction away from the second supply rollers 8.

One of the ribs 13*b* extending along front edge line of the lid member 13 is provided with a pair of supporting portions 13*e* (FIGS. 3 and 4), which extend in depthwise direction D. Further, an elongated operation piece 19 extends in the transverse direction T and is movable in its longitudinal direction. More specifically, the elongated operation piece 19 is formed with a pair of slots 19*a* extending in the longitudinal direction thereof and stepped screws 20, connected to the supporting portion 13*e*, engageably extend through the slots 19*a*. As best shown in FIG. 4, the operation piece 19 has one end (right end in FIG. 4) provided with a first locking portion 19*b* which is bent downwardly, and has another end (left end in FIG. 4) provided with a second locking portion 19*c* engageable with the locking piece 4*a* of the carriage 4. Further, as best shown in FIG. 2, a linking piece 21 is rotatably connected to each end of the operating piece 19. At the rib 13*b* and at positions adjacent the linking pieces 21, a second guide portion 13*f* defined by a pair of ribs is provided. The second guide portion 13*f* extends in the depthwise direction D similar to the first guide 13*c* for allowing a movable piece 22 to slide therethrough in the direction D. A front end of the movable piece 22 is rotatably connected to the linking piece 21, while a rear end portion of linking piece 22 is mechanically associated with the connecting piece 17. To be more specific, the rear end portion of the movable piece 22 passes through the connecting piece 17, and a distal rear end is provided with a locking piece 22*a* bent downwardly. Further, a tensile spring 25 is interposed between the downwardly extending piece 22*a* and the connecting piece 17 so as to urge the movable piece rearwardly (toward the second supply rollers 8). The biasing force of spring 25 is larger than that of spring 18. With this structure, when the operating piece 19 is moved to a first position, as shown by solid line in FIG. 2, the linking piece 21 is rotated in a direction away from the second guide portion 13*f* (in a counterclockwise direction in FIG. 2). When the operation piece 19 is moved to a second (opposite) position, the linking member is moved toward the second guide portion 13*f* as shown by the double-dotted line in FIG. 2. The movement of operation piece 19 in the second direction causes the movable arms 15 to move rearwardly (toward the second supply rollers 8) through the linking piece 21, the movable piece 22, the tension spring 25 and the connecting piece 17, and against the biasing force of the springs 18. When the rotation axis 21*a* of the linking piece 21 exceeds a dead line Y in the movement of the operation piece 19, one end of the slot 19*a* abuts the stepped screw 20 to restrain further movement of the operation piece 19. Therefore, further rotation of the linking member 21 is prevented, to thereby maintain the movable piece 22 at its rearward position. In this state, since the biasing force of the spring 25 is larger than that of the springs 18, the connecting rod 17 is urged rearwardly so that the movable arms 15 are maintained at their rearward positions. As a result, the discharge rollers 16 abut second supply rollers 8.

On the other hand, when the operation piece 19 is moved to the first position, as shown by the solid line in FIG. 2 (toward the right), the linking piece 21 is rotated to a position also shown by the solid line in FIG. 2. As a result, the connecting piece 17, the tension spring 25, and the movable piece 22 are displaced frontwardly. When the central axis 21*a* of the linking piece 21 passes over the dead line Y in the return stroke, the projections 15*a* are restored to their original frontward positions under the biasing forces of the springs 18. Therefore, the discharge rollers 16 move away from the second supply rollers 8.

As shown in FIGS. 3 and 4, at a position adjacent to a front edge line of the small lid member 14, an elongated second operation piece 23 is slidably disposed in a transverse direction T. The second operation piece 23 is formed with a pair of slots 23*a* extending in longitudinal direction thereof. Corresponding stepped screws 24 extending through slots 23*a* are threadingly engaged with the frame 1, and is slidably supported by the operation piece 23 to the frame 1. One end (left side in FIGS. 3 and 4) of the second operation piece 23 is provided with a locking portion 23*b* engageable with the locking portion 19*b* of the first operation piece 19, while another end thereof is provided with a locking portion 23*c* engageable with the engaging portion 4*a* of the carriage 4. These locking portions 23*b* and 23*c* project rearwardly. The frame 1 includes a spring holder 1*a*, and a coil spring 26 is interposed between the locking portion 23*b* and the spring holder 1*a*, so that the second operation piece 23 is normally urged toward the first operation piece 19 by the biasing force of the spring 26.

When the carriage 4 is brought to the leftmost position as shown by solid line in FIGS. 3 and 4, the engaging portion 4*a* of the carriage 4 is engaged with the locking portion 19*c* of the first operation piece 19, and the locking portion 19*b* is engaged with the locking portion 23*b* of the second operation piece 23. As a result, the second operation piece 23 is held at its leftmost position. On the other hand, when the carriage is brought to the rightmost position as shown by double-dotted line in FIGS. 3 and 4, the engaging portion 4*a* of the carriage 4 is engaged with the locking portion 23*c* of the second operation piece 23. As a result, the operation piece 23 is moved rightwardly against the biasing force of the spring 26. In response to this reciprocal motion of the second operation piece 23, the first operation piece 19 is reciprocally moved, so that the linking piece 21 is selectively rotated between its operable and retracted positions to move the discharge rollers 16 toward and away from the second supply rollers 8. The combination of the above-described movable arm 15, connecting piece 17, first operation piece 19, linking piece 21, movable piece 22 and the second operation piece 23, etc. make up of the discharge roller drive means.

According to this embodiment, a print start position and a print terminating position correspond to the leftmost and rightmost positions of the carriage 4, respectively. Further, the engaging portion 4*a* of the carriage is not engaged with the locking portion 19*c* nor the locking portion 23*c* at the print start and termination positions, respectively.

Next, operation according to the above-described embodiment will be described.

First, the carriage 4 is moved to its rightmost position for supplying the printing paper P to the platen 2. This allows the engaging portion 4*a* of the carriage 4 to engage the locking portion 23*c* of the second operation piece 23, and thereby moves the second operation piece 23 to its rightmost position as shown by the double-dotted line in FIGS. 3 and 4. Because of the engagement between the locking portion 23*b* of the second operation piece and the locking portion 19*b* of the first operation piece 19, the first operation piece 19 is also moved rightwardly. This causes linking piece 21 to move to its retracted position as indicated by the solid line in FIG. 2, so that the discharge rollers 16 are moved to their retract positions with respect to the second supply rollers 8. As described earlier, this movement is effected by movable piece 22, connecting piece 17, and movable arm 15.

When the discharge rollers 16 are moved to their retract positions, the leading end Pt of the print paper may be inserted into a space defined between the first supply roller 7 and the back-up roller 10A, and the roller drive motor 110 (FIG. 7) is energized to rotate the first and second paper supply rollers 7 and 8 in a direction indicated by an arrow A. Accordingly, the printing paper P is transported along the paper guide portion 9 through the cooperation of the first paper supply roller 7 and the back-up rollers 10A and 10B, so that the leading end of the printing paper P confronts platen 2.

Then, by the operation of the carriage drive motor 105, the print head 5 and the paper supply roller drive motor 110, the carriage 4 is moved leftwardly from its rightmost position to a print start position which is positioned slightly to the right of the leftmost position of the carriage 4. The carriage 4 moves rightwardly from its print start position to the print terminating position which is slightly left of the rightmost position of the carriage 4. Simultaneously, the printing operation is initiated by the abutment of the print head 5 onto the platen 2 through the ink ribbon and the print paper P. Upon the completion of each type line, the print head 5 is moved to its retracted position, while the carriage 4 is returned to its print start position. The print paper P is discharged toward the paper discharge side through the platen by means of the first paper supply roller 7 and the back-up rollers 10A and 10B.

In accordance with the printing operation, a predetermined length of the paper P is transported toward the paper discharge side, and the leading end of the paper P is advanced into a space defined between the second paper supply rollers 8 and the discharge rollers 16. When the tail end portion of the paper P is detected at position adjacent to the downstream side back-up roller 10B by the detector 113, the carriage 4 is once displaced to its leftmost position. This movement causes the engaging portion 4*a* to engage with the locking portion 19*c* and thereby moves the first operation piece 19 leftward. As a result, the linking piece 21 is moved from its retracted position (solid line in FIG. 2) to its operative position (double-dotted line), to move the discharge rollers 16 toward the second paper discharge rollers 8 through the movable piece 22, the connecting piece 17 and the movable arm 15. The paper P is thereby fixedly interposed between the second paper supply rollers 8 and the discharge rollers 16, before the tail end Pe of the paper P is released from the first paper supply rollers 7 and the back-up rollers 10B. Therefore, the paper feeding operation is still performable by the cooperation of the rollers 8 and 16 even after the departure of the tail end Pe from the first supply roller 7.

Then, the carriage 4 is again moved between the print start and terminating positions for printing to the tail end portion of the paper P, while the second supply rollers 8 and the discharge rollers 16 cooperatively move the paper P. Upon completion of the printing operation, the printed paper P is discharged to the outside by rollers 8 and 16.

According to the above-described embodiment, after the paper P discharged to the paper discharge side passes through the space defined between the second supply rollers 8 and the discharge rollers 16, the paper P is fixedly interposed there between. Therefore, an accurate paper gripping and feeding operation is achievable by the rollers 8 and 16. Further, these rollers 8 and 16 feed the paper P in a stable manner until the tail end Pe of the paper P passing through the platen 2. Therefore, it is possible to print to the tail end portion of the paper. As a result, all paper area can undergo printing without any blank spacing at the tail end portion thereof.

Further, since the discharge rollers 16 are movable toward and away from the second discharge rollers 8 in association with the movement of the carriage 4, any additional drive source for driving the discharge rollers 16 is not required. Therefore, printer production costs are minimized.

In addition, the discharge roller drive mechanism is supported by the lid member 13 which covers the path of the carriage 4. Therefore, by removing the lid members 13 and 14, the upper portion of the carriage moving path is opened, to thereby facilitate inspection and maintenance of the carriage 4 and the print head 5 etc. through the opening 12.

Incidentally, several modifications may be effected to this embodiment without departing from the spirit and scope of the invention. For example, the roller drive mechanism can be directly supported on the frame 1.

Figure 6:
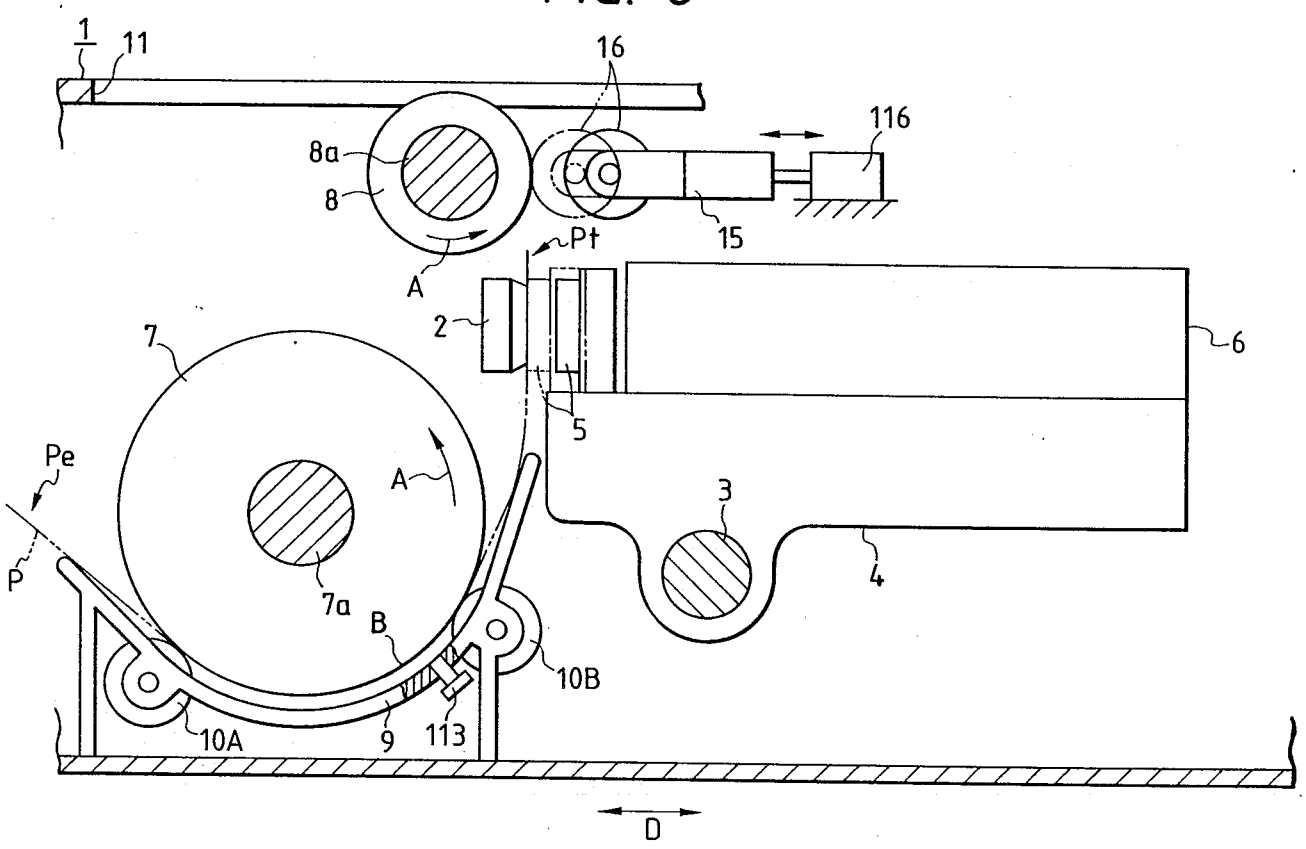
FIG. 6 is a side view partly cross-sectional showing a printing apparatus according to a second embodiment of the present invention.

A second embodiment of the invention will now be described in connection with FIGS. 6, 8 and 9, wherein like parts and components are designated by the same reference numerals and characters as those shown in the first embodiment.

In the first embodiment, the discharge roller drive means is a mechanical arrangement without an additional power source for driving the discharge roller 16. On the other hand, according to the second embodiment, instead of the mechanical arrangement, a solenoid 116 is used and is coupled to one end of the movable arm 15 and at the other end rotatably supports the discharge roller 16. More specifically, as shown in FIG. 6, the movable arm 15 has a tip end rotatably supporting the discharge roller 16. The movable arm 15 is connected to the solenoid 116 (FIG. 6). In response to energization and deenergization of the solenoid 116, the movable arm 15 together with the discharge roller 16 are moved toward and away from the second roller 8 between paper feed operable and inoperable positions shown by the double-dotted line and solid line, respectively.

Next, several examples of electric circuits in the first and second embodiments for operating the printer will be described with reference to FIGS. 7 and 8.

Figure 7:
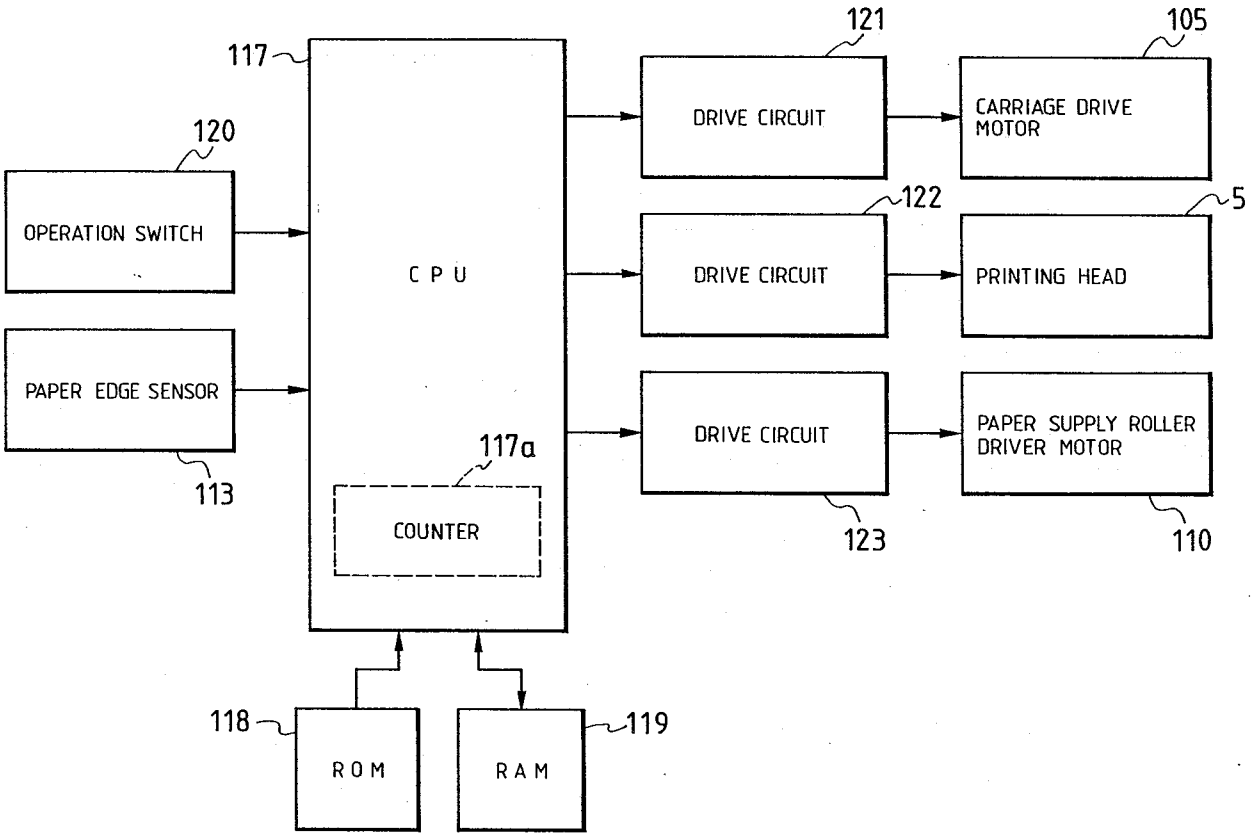
FIG. 7 is a block diagram showing an electrical circuitry connection with respect to mechanical components according to a first embodiment of the invention.
Figure 8:
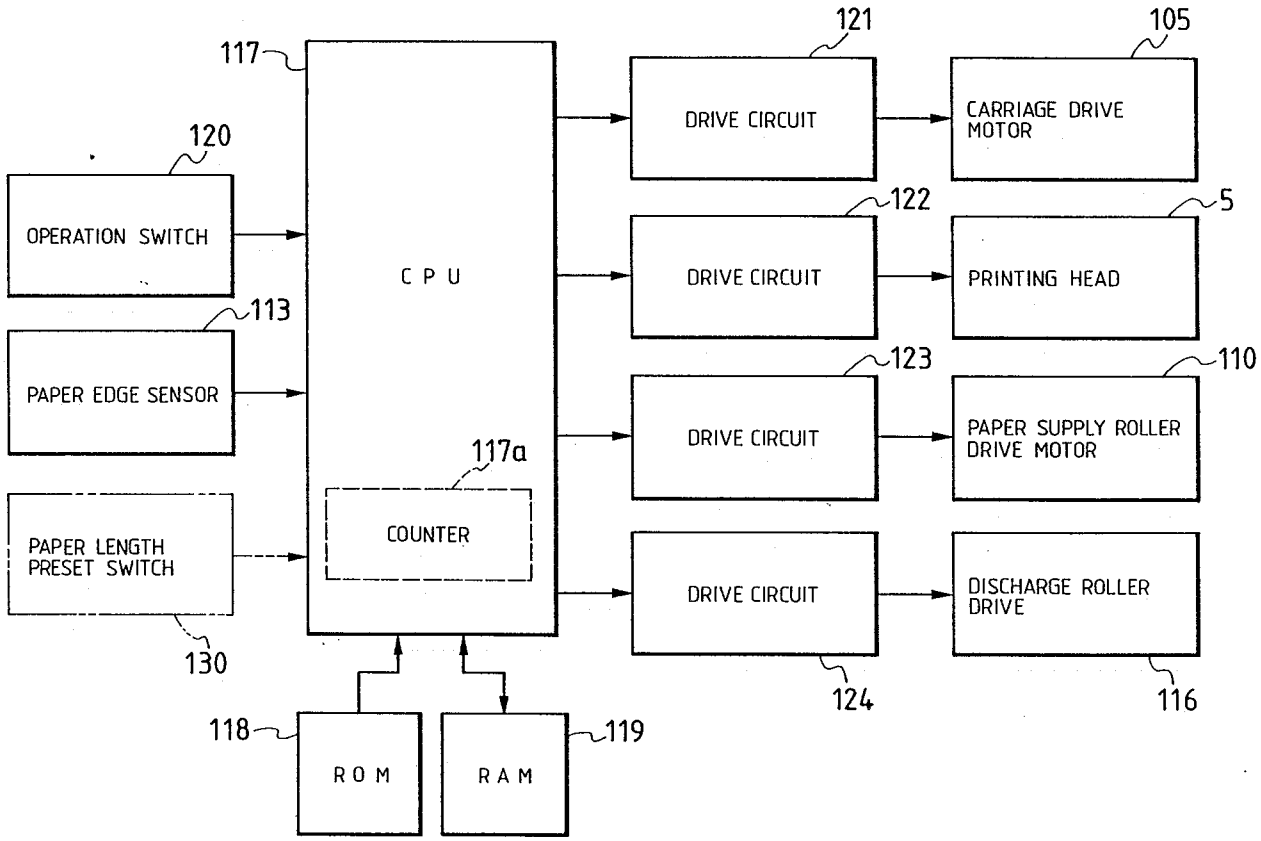
FIG. 8 is a block diagram showing an electrical circuit according to second and third embodiments of the present invention.
Figure 9:
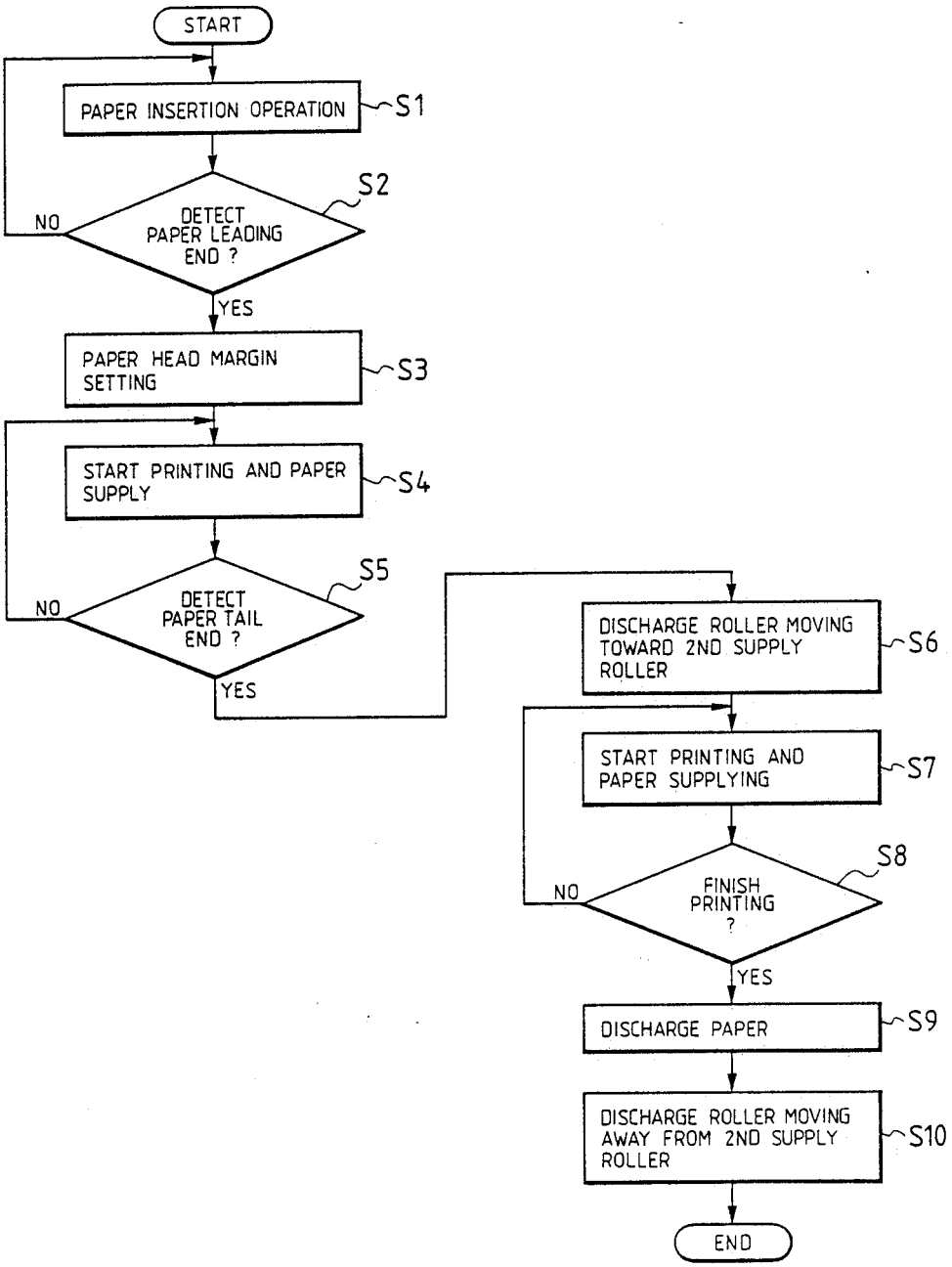
FIG. 9 is a flow chart showing an operational sequence according to first and second embodiments of the present invention.

As shown in FIGS. 7 and 8, a central processing unit (CPU) 117 which constitutes a control means houses a counter 117*a* for counting a driving pulse number of the paper supply roller drive motor 110. This CPU 117 controls printer operation in accordance with a program stored in a read only memory (ROM) 118 connected to the CPU 117. Further, the CPU 117 is also connected to a random access memory (RAM) 119 where predetermined data is programmable and readable. Various operation switches 120 and the paper tail end detection sensor 113 are connected to an input side of CPU 117. The sensor 113 and the CPU 117 constitute, in combination, signal generating means. The above-described carriage drive motor 105, the print head 5, and the paper supply roller drive motor (pulse motor) 110, through drive circuits 121, 122 and 123, are respectively connected to an output side of CPU 117. In the second embodiment, shown in FIG. 8, the solenoid 116 for moving the discharge rollers 16 is also connected to the CPU 117 through a drive circuit 124.

One operational sequence according to the first and second embodiments will be described with reference to FIG. 9.

First, in order to put print paper P into the printer, the leading end Pt of the paper P is inserted into the space defined between the first paper supply roller 7 and the upstream side back-up roller 10A. A predetermined operation switch 120 is operated, so that, in Step Sl, the roller drive motor 110 is energized in accordance with the control signal from the CPU 117, to thereby rotate the first and second paper supply rollers 7 and 8 in the direction indicated by the arrow A shown in FIG. 1. As a result, the printing paper P is fed toward the platen along the paper guide 9 through the cooperation of the first paper supply roller 7 and the back-up roller 10A.

In this case, according to the first embodiment, the engaging piece 4*a* of the carriage 4 is engaged with the locking portion 23*c* of the second operation piece 23 to position the discharge rollers at their retracted positions with respect to the second paper supply rollers 8. On the other hand, according to the second embodiment, the solenoid 116 is in a deenergized condition, so that the discharge rollers 16 are held at their retracted positions.

Next, in Step S2, the paper edge detecting sensor 113 detects the leading edge Pt of the paper P. Upon detection, in Step S3, CPU 117 actuates the counter 117*a*. Upon completion of counting the predetermined drive-pulse numbers of the supply roller drive motor 110 by the counter 117*a*, CPU 117 deenergizes the motor 110. As a result, as shown in FIGS. 1 and 6, the leading edge portion of the printing paper P is brought into opposed relation with the platen 2 at a predetermined distance corresponding to a head spacing or margin of the paper 2.

Thereafter, in Step S4, by the operation of the operation switch 120, the carriage drive motor 105, the print head 5 and the paper supply roller drive motor 110 are operated by the instruction from CPU 117 in accordance with printing data provisionally inputted from an input means (not shown) and stored into the RAM 119. Accordingly, the carriage 4 is reciprocally moved, and at the same time, the printing operation is started by abutting the print head 5 against the platen 2 through the ink ribbon and the paper P. At the completion of every printed line, the print head 5 is moved to its retracted position, and the carriage 4 is restored to its original position. At the same time, the first paper supply roller 7 and back-up rollers 10A and 10B feed the paper from the platen 2 toward the paper discharging direction by a length corresponding to a single line space.

The Step S4 operation is repeatedly carried out until the tail edge Pe of the paper P is detected by the paper edge sensor 113 in Step S5. In Step S4, according to the second embodiment, the paper supply roller drive motor 110 can be rotated in reverse direction to temporarily feed the paper toward paper supply side to remove paper slacking.

In Step S6, when the tail edge Pe of the paper P is detected by the sensor 113 in Step S5, according to the first embodiment, CPU 117 actuates the carriage drive motor 105 to engage the engaging portion 4*a* with the locking portion 19*c* of the first operation piece 19. As a result, the discharge rollers 16 are brought into abutment with the second paper supply rollers 8. On the other hand, according to the second embodiment, in Step S6, upon detection of the paper tail end Pe by the sensor 113 in Step S5, CPU 117 energizes the discharge roller drive solenoid 116. As a result, the discharge rollers 16 is moved toward the second rollers 8.

It is important to note that in the first and second embodiments, the discharge rollers 16 and the second paper supply rollers 8 nip the paper P prior to release of the paper tail end Pe from between the first paper supply roller 7 and the downstream side back-up roller 19B. In this case, the paper P is temporarily nipped or gripped both upstream and downstream of the printing portion. The upstream side portion is nipped between the first supply roller 7 and the back-up roller 10B, and the downstream side portion is nipped between the second supply rollers 8 and the discharge rollers 16. However, the upstream nipping is promptly released when the paper is slightly moved toward the paper discharge side. This occurs because the slight movement causes the tail edge portion Pe to exit the nip between the first roller 7 and the back-up roller 10B. There after, only the second supply rollers 8 and the discharge rollers 16 serve to feed the paper P. Therefore, in the present invention, since the paper P is not subjected to nipping for a prolonged period on both the upstream and downstream sides, undesirable tension application or slacking to the paper can be minimized in spite of inaccuracy in peripheral speeds of the first and second rollers 7 and 8.

Next, in Step S7, the printing and paper feed operations are performed for printing to the tail end zone of the paper P. In Step S8, a print operation termination signal is generated when the counter 117*a* counts a predetermined number of pulses corresponding to a predetermined bottom print line on the paper. When the print terminating signal is inputted, CPU 117 resets counter 117*a* in Step S9, to operate the supply roller drive motor 110 until the counter counts a predetermined number of drive pulses. As a result, the second paper supply rollers 8 and the discharge rollers 16 discharge the pape P toward the discharge side.

Then, in Step S10, in the first embodiment, the CPU 117 actuates the carriage drive motor 105 to move the carriage to engage the engaging portion with the locking portion 38*c* of the second operation piece 23. This causes the discharge rollers 16 to move to their retract positions. On the other hand, in the second embodiment, the CPU 117 deenergizes the discharge roller drive solenoid 116, so that the discharge rollers 16 move to their retract positions.

In view of the above, according to the foregoing embodiments, the second paper supply rollers 8 and the discharge rollers 16 nip the printing paper P immediately before the first supply roller 7 and the back-up roller 10B release to tail edge Pe of the paper P. Therefore, excellent paper feeding is attainable without any trouble. Further, even if there is a minute error in peripheral speeds between the first and second paper supply rollers 7 and 8, the paper can still be transported without applying excessive tension or allowing slacking to occur. As stated earlier, this occurs because first roller 7 and back-up roller 10B release the paper tail edge Pe immediately after the paper is nipped between second rollers 8 and discharge rollers 16. Therefore, high dimensional accuracy in the peripheral speeds and outer diameters of the rollers 7 and 8 are not severely required. Furthermore, the rollers 8 and 16 nip the paper in a stable manner during printing to the tail end zone of the paper, allowing printing all the way to the bottom of the sheet.

Moreover, in the second embodiment, after the first supply roller 7 and the back-up roller 10B release the paper end Pe, the roller drive motor 110 can be rotated in reverse to feed the paper P in the opposite direction. In this case, the paper P is initially driven by the second supply rollers 8 and the discharge rollers 16, and then the tail edge Pe of the paper P is again nipped between the first roller 7 and the back-up roller 10B. The discharge roller drive solenoid 116 is deenergized upon detection of the paper tail edge Pe by the sensor 113 thereby moving the discharge rollers 16 away from the second rollers 8. The paper P is then only held between the first roller 7 and the back-up roller 10B and subsequent back-up roller 10A, and is fed thereby. During reverse feeding as with normal feeding, the paper undergoes nipping at both the upstream and downstream sides of the platen for an extremely short period of time. Therefore, as described above, high dimensional accuracy of the rollers 7 and 8 are not required. The reverse feeding feature allows the left half portion of the paper to undergo printing in the normal paper feed direction, and right half portion of the paper to undergo printing during reverse paper feeding for printing two pages of data on a single piece of paper. Furthermore, printing may be accurately performed at a predetermined position on the paper, as is necessary on a form, paper slip, etc.

A third embodiment of the invention will now be described with reference to FIGS. 8 and 10. The third embodiment also uses the solenoid 116 instead of the mechanical discharge roller drive arrangement used in the first embodiment. Therefore, the construction depicted in FIG. 6 is also available in the third embodiment.

According to the third embodiment, instead of the paper edge sensor 113, paper length preset switch 130 is provided as shown by the double-dotted line in FIG. 8. When inserting the printing paper P into the printer, a length of the paper is inputted through switch 130. This allows CPU 117 to calculate the corresponding driving pulse number for the paper supply roller drive motor 110 so that rollers 7 and 8 operate from print start time to the time at which the discharge rollers 16 perform their reciprocal movement. The point at which the reciprocal movement occurs corresponds to the length of the paper and processing data stored in ROM 118. The drive pulse number corresponds to the pulse numbers for allowing continuous driving of the motor 110 from a time at which the leading end Pt of the paper P confronts the platen 2 to a time at which the tail end Pe of the paper P passes over a region B in the vicinity of the downstream side of back-up roller 10B (see FIG. 6). The calculated drive pulse number is stored in the RAM 119. Then, by operating the operational switch 120, a start up signal is inputted, so that the CPU 117 will send output signals to the carriage drive motor 105, the print head 5, and the roller drive motor 110. Accordingly, predetermined paper insertion, printing, and paper feed operations are performed in accordance with a control program stored in the ROM 118. Simultaneously, from the print start time, the counter 117*a* starts counting the number of drive pulses of the roller drive motor 110.

When the number of counted drive pulses equals the preset value, a discharge signal is sent to the solenoid 116 to energize it. Therefore, in the third embodiment, signal generating means is provided by the CPU 117 and the operation switch 120.

Figure 10:
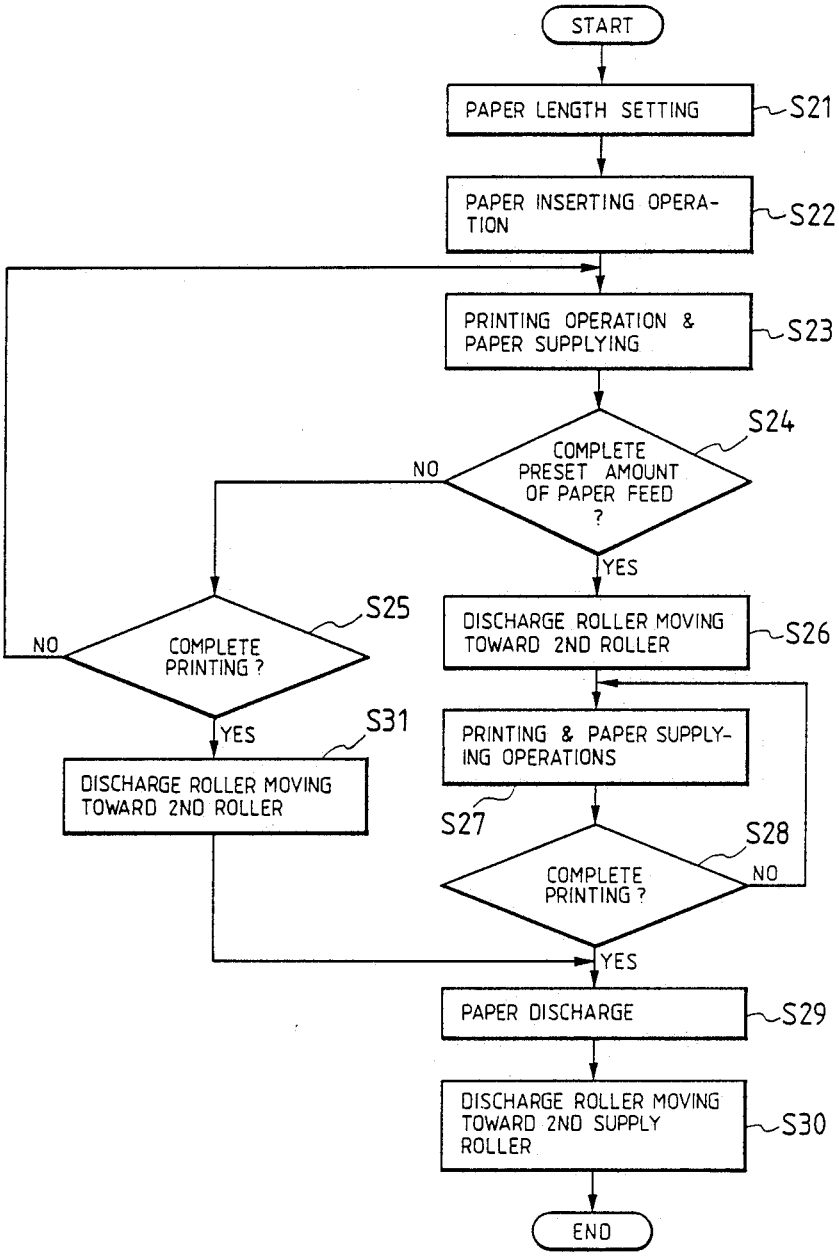
FIG. 10 is a flow chart showing an operational sequence according to the third embodiment of the present invention.

The operation of the third embodiment will become apparent from the flow chart shown in FIG. 10.

In Step S21, the length of the paper P is set by the preset switch 130. In Step S22, when the leading end Pt of the paper P is inserted between the first supply roller 7 and the upstream side back-up roller 10A, and the operational switch 120 is operated, CPU 117 supplies an output signal to the roller drive motor 110 for energizing it in accordance with the predetermined drive pulse number. As a result, after the paper passes through the upstream and downstream side back-up rollers 10A and 10B, the leading end Pt of the paper P confronts the platen 2 to perform a head space setting for the paper P.

Next, in Step S23, the carriage drive motor 105, the print head 5, and the roller drive motor 110 are operated in accordance with the printing data provisionally stored in RAM 119, and the counter 117*a* starts its counting operation. After each printed line, the paper P advances toward the paper discharge side by the first supply roller 7 and the back-up rollers 10A and 10B.

Then, in Step S24, the counted number of pulses is compared to the preset number corresponding to the paper length. In Step S25, prior to completion of the counting, the input signal is checked to determine if printing is complete. If the counted number of pulses equals the preset number before receipt of the print termination signal (i.e., yes path from Step S24), then, in Step S26, CPU 117 sends a discharge signal to energize the solenoid 116. The paper is thereby nipped between the second paper supply rollers 8 and the discharge rollers 16 prior to the departure of the pape tail end Pe from the first roller 7 and the back-up roller 10B. In Step S27, the printing and paper feeding operations are performed, and then, in Step S28, the input signal is checked to determine if printing is complete. Upon input of this signal, CPU 117 sends a signal to the solenoid 116 for discharging the paper P by the second supply roller 8 and the discharge roller 16. Thereafter, the paper supply roller drive motor 110 is deenergized. In Step S30, the solenoid 116 is deenergized to move the discharge rollers 16 away from the second rollers 8.

On the other hand, if the print termination signal is inputted in the Step S25, the solenoid 116 is actuated for nipping the paper by the rollers 8 and 16 in Step S31, and then, Steps S29 and S30 are subsequently conducted.

In view of the above, according to the third embodiment, stabilized paper feeding is achievable until the paper tail end Pe passes through the platen 2, enabling excellent print on the paper tail end zone, similar to the first and second embodiments.

While the invention has been described with reference to the specific embodiments, it will be apparent to those skilled in the art that various changes and modifications can be made therein without departing from the spirit and scope of the invention. For example, only a single paper supply roller having a relatively large diameter is available which may also serve as the platen. The carriage is positioned beside the platen/paper supply roller in the vicinity of the cross sectional center portion thereof. At least one back-up roller is in rotational contact with the platen at the upstream side of the carriage, and the discharge roller is movably provided at the downstream side of the carriage. The discharge roller is movable toward and away from the platen/paper supply roller.

What is claimed is:

1. A printer comprising:

a frame;

a platen for supporting printing paper;

a carriage reciprocally movable along said platen and having a print head mounted thereon, said platen, said carriage, and said print head defining a printing portion;

paper feed means for feeding said printing paper through said printing portion, said paper feed means including a first paper supply roller disposed on the upstream side of said printing portion and a second paper supply roller disposed on the downstream side of said printing portion;

at least one back-up roller disposed at an upstream side of said printing portion and rotationally abutted against said paper feed means;

at least one discharge roller disposed at a downstream side of said printing portion and movable toward and away from said paper feed means; and discharge roller driving means for moving said discharge roller toward and away from said paper feed means, said discharge roller driving means moving said at least one discharge roller toward said paper feed means for nipping said printing paper therebetween prior to the release of a tail edge of said printing paper from between said at least one back-up roller and said paper feed means;

operation means disposed in parallel with said platen and having a first end portion and a second end portion, each said portion being engageable with said carriage, said operation means for moving said discharge roller toward and away from said paper feed means;

a linking member connected to said operation means; and a movable portion connected between linking member and said discharge roller;

wherein said carriage is movable between leftmost and rightmost positions, said carriage being engageable with said first end portion of said operation means at said leftmost position and being engageable with said second end portion of said operation means at said rightmost position.

2. The printer as defined in claim 1, further comprising detecting means for detecting a tail end of said printing paper, said detecting means being provided at an upstream side of said discharge roller and transmitting a signal to said discharge roller driving means.

3. The printer as defined in claim 2, wherein said discharge roller driving means has a driving mechanism mechanically associated with said carriage for moving said discharge roller in response to reciprocal motion of said carriage.

4. The printer as defined in claim 3, wherein said frame includes an opening, said opening being covered with a lid member, said discharge roller driving mechanism being supported by said lid member.

5. The printer as defined in claim 1, wherein said carriage is movable along a print-effected stoke which is within a range smaller than a maximum range between said leftmost and rightmost positions of said carriage.

6. The printer as defined in claim 1, wherein said movable portion comprises:

a first movable piece having a first end and a second end, said first end connected to said discharge roller;

a second movable piece a first end and a second end, said first end connected to said linking member; and a connecting member for connecting together said second ends of said first and second movable pieces.

7. The printer as defined in claim 6, further comprising:

a first spring connected to said first movable piece for biasing said first movable piece in a direction away from said paper feed means; and a second spring connected to said movable portion to bias the movable portion toward said paper feed means, the biasing force of said second spring being larger than that of said first spring, said first and second movable pieces being movable in response to the movement of said linking member between a first position and second position, said linking member movable in response to movement of said operation means.

8. A printer comprising:

a frame;

a platen for supporting printing paper;

a carriage reciprocally movable along said platen and having a print head mounted thereon, said platen, said carriage, and said print head defining a printing portion;

paper feed means for feeding said printing paper through said printing portion;

at least one back-up roller disposed at an upstream side of said printing portion and rotationally abutted against said paper feed means;

at least one discharge roller disposed at a downstream side of said printing portion and movable toward and away from said paper feed means;

discharge roller driving means for moving said discharge roller toward and away from said paper feed means, said discharge roller driving means for moving said at least one discharge roller toward said paper feed means to nip said printing paper therebetween prior to the release of a tail edge of said printing paper from between said at least one back-up roller and said paper feed means; and detecting means for detecting a tail end of said printing paper, said detecting means being provided at an upstream side of said discharge roller, said detecting means for transmitting a signal to said discharge roller driving means to move said at least one discharge roller towards said paper feed means to nip the paper therebetween.

9. The printer as defined in claim 8, wherein said paper feed means comprises a first paper supply roller disposed at the upstream side of said printing portion, and a second paper supply roller disposed at the downstream side of said printing portion.

10. The printer as defined in claim 8, wherein said discharge roller driving means comprises:

an operation arm having a first end rotatably supporting said at least one discharge roller, and having a second end;

a solenoid connected to said second end of said operation arm; and control means for controlling said solenoid in response to paper position and printing phase.

11. The printer as defined in claim 10, further comprising detection means for detecting edges of said paper, said detection means being provided at an upstream side of said discharge roller and being adapted to send a signal to said control means.

12. The primer as defined in claim 10, further comprising paper length setting means connected to said control means for selectively providing a paper length value to said control means for use by said control means in controlling said solenoid.

13. A printer comprising:

a frame including an opening formed therein;

a removable lid member for covering said opening;

a platen for supporting printing paper;

a carriage reciprocally movable along said platen and having a print head mounted thereon, said platen, said carriage, and said print head defining a printing portion, said printing portion at lest partially disposed beneath said cover, said cover being removable for accessing and inspecting said printing portion;

paper feed means for feeding said printing paper through said printing portion;

at least one back-up roller disposed at an upstream side of said printing portion and rotationally abutted against said paper feed means;

at least one discharge roller disposed at a downstream side of said printing portion and movable toward and away from said paper feed means;

discharge roller driving means for moving said discharge roller toward and away from said paper feed means, at least a portion of said discharge roller means being disposed within said removable cover, said discharge roller driving means for moving said at least one discharge roller toward said paper feed means to nip said printing paper therebetween prior to the release of a tail edge of said printing paper from between said at least one back-up roller and said paper feed means; and detecting means for detecting a tail end of said printing paper, said detecting means being provided at an upstream side of said paper feed means, said detecting means for transmitting a signal to said discharge roller driving means to move said at least one discharge roller towards said paper feed means to nip the paper therebetween.

* * * * *

UNITED STATES PATENT AND TRADEMARK OFFICE

CERTIFICATE OF CORRECTION

PATENT NO. : 4,961,658

DATED : October 9, 1990

INVENTOR(S) : KAZUHIKO TAKAGI

It is certified that error appears in the above-identified patent and that said Letters Patent is hereby corrected as shown below:

IN THE ABSTRACT line 4, before "defining" insert --said platen, said carriage, and said print head--, change "print point" to --printing portion--, and change "feed rollers" to --feeder--;

line 5-7 and 9, change "point" to --portion--;

lines 10-11, change "another of said paper feed rollers" to --paper feeder--;

line 12 , change "roller" to --paper feeder--; and line 14, change "said roller" to --said paper feeder--.

IN THE CLAIMS

Claim 12, column 15, line 3, change "primer" to --printer--.

Claim 13, column 15, line 15, change "lest" to --least--.

Signed and Sealed this

Fourteenth Day of January, 1992

*Attest:*

HARRY F. MANBECK, JR.

*Attesting Officer*

*Commissioner of Patents and Trademarks*